US007766125B2

(12) United States Patent
Fowler

(10) Patent No.: US 7,766,125 B2
(45) Date of Patent: Aug. 3, 2010

(54) COLLAPSIBLE WORK HORSE

(75) Inventor: Gerald L. Fowler, 229 E. Fourth St., Berwick, PA (US) 18603

(73) Assignee: Gerald L. Fowler, Berwick, PA (US)

( * ) Notice: Subject to any disclaimer, the term of this patent is extended or adjusted under 35 U.S.C. 154(b) by 997 days.

(21) Appl. No.: 11/503,728

(22) Filed: Aug. 14, 2006

(65) Prior Publication Data

US 2008/0035427 A1 Feb. 14, 2008

(51) Int. Cl.
*E04G 1/34* (2006.01)
*B25H 1/06* (2006.01)
*B25B 1/02* (2006.01)

(52) U.S. Cl. ..... 182/155; 182/163; 144/286.1; 269/43

(58) Field of Classification Search ..... 269/139, 269/43, 289 MR; 29/281.1; 144/286.1, 286.5, 144/287; 182/163, 155, 182.1, 186.4
See application file for complete search history.

(56) References Cited

U.S. PATENT DOCUMENTS 3,107,909 A * 10/1963 Kuchenbecker, Sr. ..... 269/89
3,951,233 A * 4/1976 Meyers ..... 182/155
4,448,406 A * 5/1984 Hallberg et al. ..... 269/224
D276,074 S * 10/1984 Wagster ..... D25/67
4,566,150 A * 1/1986 Boothe ..... 16/332
4,697,305 A * 10/1987 Boothe ..... 16/329
4,951,780 A * 8/1990 Kim ..... 182/27
4,967,877 A * 11/1990 Wallman et al. ..... 182/155
4,974,651 A * 12/1990 Carmon et al. ..... 144/286.1
D321,117 S * 10/1991 O'Mealy et al. ..... D8/71
5,052,517 A * 10/1991 Wallman et al. ..... 182/155
5,096,019 A * 3/1992 Kelsay ..... 182/155
5,320,150 A * 6/1994 Everts et al. ..... 144/287
5,441,091 A * 8/1995 Collins ..... 144/287
5,526,856 A * 6/1996 Pedri ..... 144/287
RE35,627 E * 10/1997 Estrem ..... 144/329
5,722,308 A * 3/1998 Ceroll et al. ..... 83/438
5,848,783 A * 12/1998 Weissenborn ..... 269/97
6,585,248 B2 * 7/2003 Baud ..... 269/296
6,896,102 B1 * 5/2005 Nichol ..... 182/186.5
7,047,597 B2 * 5/2006 Lee ..... 16/233
7,232,120 B2 * 6/2007 Campbell et al. ..... 269/139
7,481,254 B2 * 1/2009 Welsh et al. ..... 144/286.1
2001/0022205 A1 * 9/2001 Ayala et al. ..... 144/286.1
2002/0088091 A1 * 7/2002 Grote et al. ..... 16/429

(Continued)

*Primary Examiner*—Katherine W Mitchell
*Assistant Examiner*—Daniel Cahn
(74) *Attorney, Agent, or Firm*—The Webb Law Firm

(57) ABSTRACT

A collapsible work horse has legs pivotally mounted to opposing surfaces of a support beam. The legs are secured in the extended position by a two-part locking arrangement. In one non-limiting embodiment of the invention, a first part of a locking arrangement is mounted to each of the first ends of the legs adjacent the pivot point of its respective leg, and a second part of the locking arrangement is mounted to the supporting member. When the legs are in the extended position, the first and second parts of the locking arrangement engage one another to securely fix the legs in the extended position. In another non-limiting embodiment of the invention, a plurality of work horses are assembled with a tool support and work piece supports to provide a work station. The tool support and work piece supports are designed to be fixable in a compact storage arrangement.

6 Claims, 9 Drawing Sheets

U.S. PATENT DOCUMENTS

2003/0024603 A1* 2/2003 Pica ..... 144/286.5
2007/0029715 A1* 2/2007 Liu ..... 269/139
2008/0035427 A1* 2/2008 Fowler ..... 182/153

* cited by examiner

COLLAPSIBLE WORK HORSE

BACKGROUND OF THE INVENTION

1. Field of the Invention

This invention relates to a collapsible work horse having first and second pairs of legs pivotally mounted to a support beam to move from an extended or working position to a storage and/or transporting, e.g., collapsed, position, and a locking arrangement to lock the legs in the extended position and, more particularly, to a collapsible work horse having the legs secured in the extended position by a plunger mounted in each of the legs and biased into a hole in the support beam. The invention further relates to a work station having one or more work horses for supporting a shaping tool and for supporting the pieces to be shaped.

2. Discussion of the Technical Problems

In general, work horses, also known as sawhorses or trestles, include a first pair of legs secured to one side of a support beam and a second pair of legs secured to an opposite side of the support beam. The legs can be fixedly secured to the support beam using fasteners, e.g. but not limited to, nails, screws, and/or nut and bolt arrangements, or detachably secured to the support beam using clamps. In general, the clamps include a pair of elongated members pivotally mounted together such that moving one end of the members away from one another moves the opposite ends of the members toward one another against the support beam. In another arrangement, the legs are secured by pivotally attaching the legs to the support beam as taught in U.S. Pat. No. 3,951,233 (hereinafter also referred to as "U.S. Pat. No. '233").

Although the presently available work horse designs are acceptable for their intended use, they have drawbacks. More particularly, work horses that have the legs and support beam fixedly secured together are usually moved and/or stored in the assembled state, which results in wasted unused space. The work horses that have the legs detachably secured to the support beam reduces the amount of unused space required for storage but requires disassembling the work horse, keeping track of the disassembled parts, and assembling the parts to use the work horse.

The collapsible work horse of U.S. Pat. No. '233 eliminates many of the problems discussed above; however, the work horse of U.S. Pat. No. '233 has limitations. More particularly, the extended legs of the work horse disclosed in U.S. Pat. No. '233 are maintained in the extended position by a constant frictional force applied to the pivot point of the legs. The frictional force is applied by tightening the bolt at the pivot point. For a detailed discussion of the arrangement to maintain the legs in the extended position, reference can be made to Patent '233.

As can be appreciated, tightening bolts to secure the legs in the extended position requires the use of the tool to tighten the bolts to secure the legs in the extended position and to loosen the bolts to move the legs to the collapsed position. It can be appreciated by those skilled in the art that it would be advantageous to provide a work horse that has legs that can be moved between the extended position and the collapsed position and does not have the drawbacks and/or limitations of the presently available work horses.

SUMMARY OF THE INVENTION

This invention relates to a collapsible work horse having, among other things, a support member having a first surface and an opposite second surface; a first pair of legs, with each leg of the first pair having a first end and an opposite second end, with the first end of the first pair of legs pivotally mounted at a pivot point to the first surface of the support member; and a second pair of legs, each leg of the second pair having a first end and an opposite second end, with the first end of the second pair of legs pivotally mounted at a pivot point to the second surface of the supporting beam. The legs of the first pair of legs and the legs of the second pair of legs are in spaced relationship to one another to move the legs between an extended position and a collapsed position. The legs are maintained in the extended position by a two-part locking arrangement. The first part of a locking arrangement is mounted to each of the first end of the legs adjacent the pivot point of its respective leg, and the second part of the locking arrangement mounted to the support member, wherein with the legs in the extended position, the first and second parts of the locking arrangement engage one another to secure the leg in the extended position.

In one non-limiting embodiment of the invention, the first part of the locking arrangement includes a spring-biased plunger, and the second part of the locking arrangement includes a hole to receive the first end of the plunger. When the leg is in the extended position, the end portion of the plunger is biased into the hole.

In still another non-limiting embodiment of the invention, each of the legs of the first and second pairs of legs includes a first surface and an opposite second surface, with the first surface at the first end of the leg in facing relationship to portions of the support member, the plunger includes a second opposite end and a shoulder or stop member fixed between the first and second ends of the plunger. The first part of the locking arrangement further includes a housing having a first open end at the first side of the leg and an opposite second open end at the second surface of the leg, with the first and second openings smaller than the shoulder to capture the shoulder in the housing. The first end of the plunger is biased to extend out of the first end of the housing and the second end of the plunger extends out of the second end of the housing. A spring is mounted on the plunger between the second end of the housing and the shoulder or stop member of the plunger. In this manner, moving the second end of the plunger out of the housing compresses the spring, and releasing the second end of the plunger moves the shoulder toward, and the first end of the plunger out of, the first end of the housing under the biasing action of the spring.

This invention further relates to a tool support that can be used with a work horse, for example but not limited to, the collapsible work horse of the invention. In one non-limiting embodiment of the tool support of the invention, the tool support includes a support platform having a first major surface and an opposite second major surface, and a first and second vise arrangement mounted on the second major surface of the platform in spaced relationship to one another. The second major surface of the support platform is mounted on the support member, with the first and second vise arrangements engaging sides of the support member.

In another non-limiting embodiment of the tool support of the invention, at least one of the first and second vise arrangements includes a guide shaft mounted to the support platform in spaced relationship to the second surface of the support platform. A first jaw member is slidably mounted on the guide shaft and a detachably securing arrangement mounting the first jaw member, wherein with the detachably securing arrangement in a non-engaged position, the first jaw member can move along the guide shaft, and with the detachably securing arrangement in an engaged position, the first jaw member is secured in a position on the guide shaft. A second jaw member is movably mounted on the guide shaft and driven by a screw drive mounted on the shaft and operatively connected to the second jaw member. The screw drive moves the second jaw member toward the first jaw member to engage the sides of the first support member and to move the second jaw member away from the first jaw member.

The invention still further relates to a work piece support that can be used with a work horse, for example but not limited to, the collapsible work horse of the invention. In one non-limiting embodiment, the work piece support includes an engaging cover plate member mounted over an end of the support beam of the work horse. The cover plate member has a top plate, a first side, an opposite second side, a third side between the first and second sides, and a first lock screw passing through one of the first and second sides of the cover plate member to engage the support beam of the work horse. A shaft receiving hole is provided on the third side of the engaging cover plate member, with a second lock screw passing through a wall of the shaft receiving hole. A cylindrical support is rotatably mounted on one end of a shaft, with the body of the shaft passing through the shaft receiving hole. The cylindrical support is in a fixed position above the support member of the work horse by the second lock engaging the shaft of the work piece support.

In another non-limiting embodiment of the invention, the support platform of the tool support has a cut out adjacent a side of the support platform of the tool support, and the tool support and the work piece support in a storage position includes the shaft of the cylindrical support positioned between the first and second sides of the engaging cover plate member and biased against one of the first and second sides of the plate member by the first lock screw, and the engaging cover plate member secured between the first and second jaw members of the work piece support between the first and second jaw members.

The invention further relates to a work station having a first material shaping position and one or more support positions. The shaping position includes the tool support of the invention mounted on a first work horse, e.g., the collapsible work horse of the invention, and a shaping tool secured on the tool support. The support positions each include a work piece support of the invention mounted on a second work horse, e.g., the collapsible work horse of the invention. A support board has one end attached to the shaping tool and the other end supported at the support positions.

BRIEF DESCRIPTION OF THE DRAWINGS

Further advantages and details of the invention will be explained in more detail with reference to the exemplary embodiment illustrated in the schematic figures, in which like reference numbers identify like parts throughout.

DETAILED DESCRIPTION OF THE INVENTION

Figure 1:
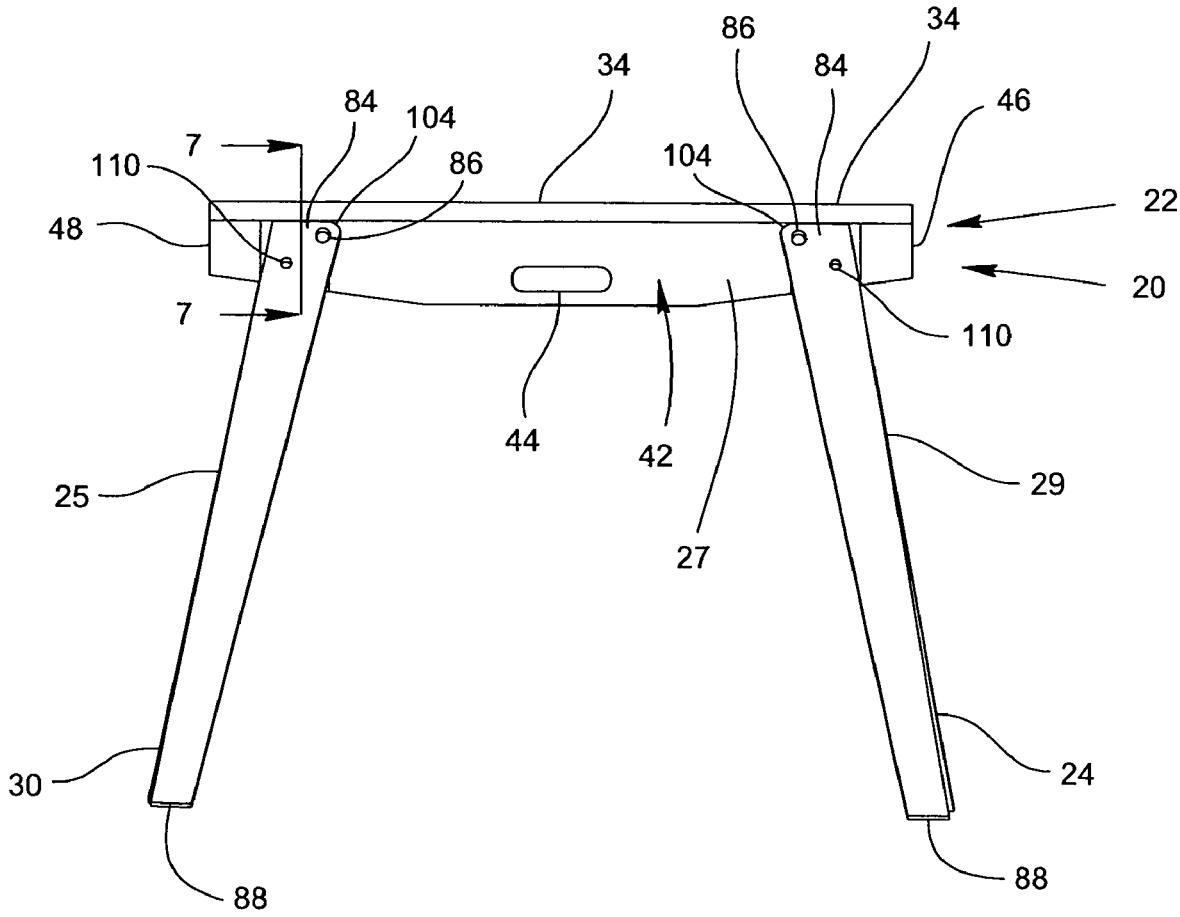
FIG. 1 is an elevated front view of a non-limiting embodiment of a collapsible work horse of the invention.

Before discussing several non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise, in the following discussion like numbers refer to like elements.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10.

Figure 2:
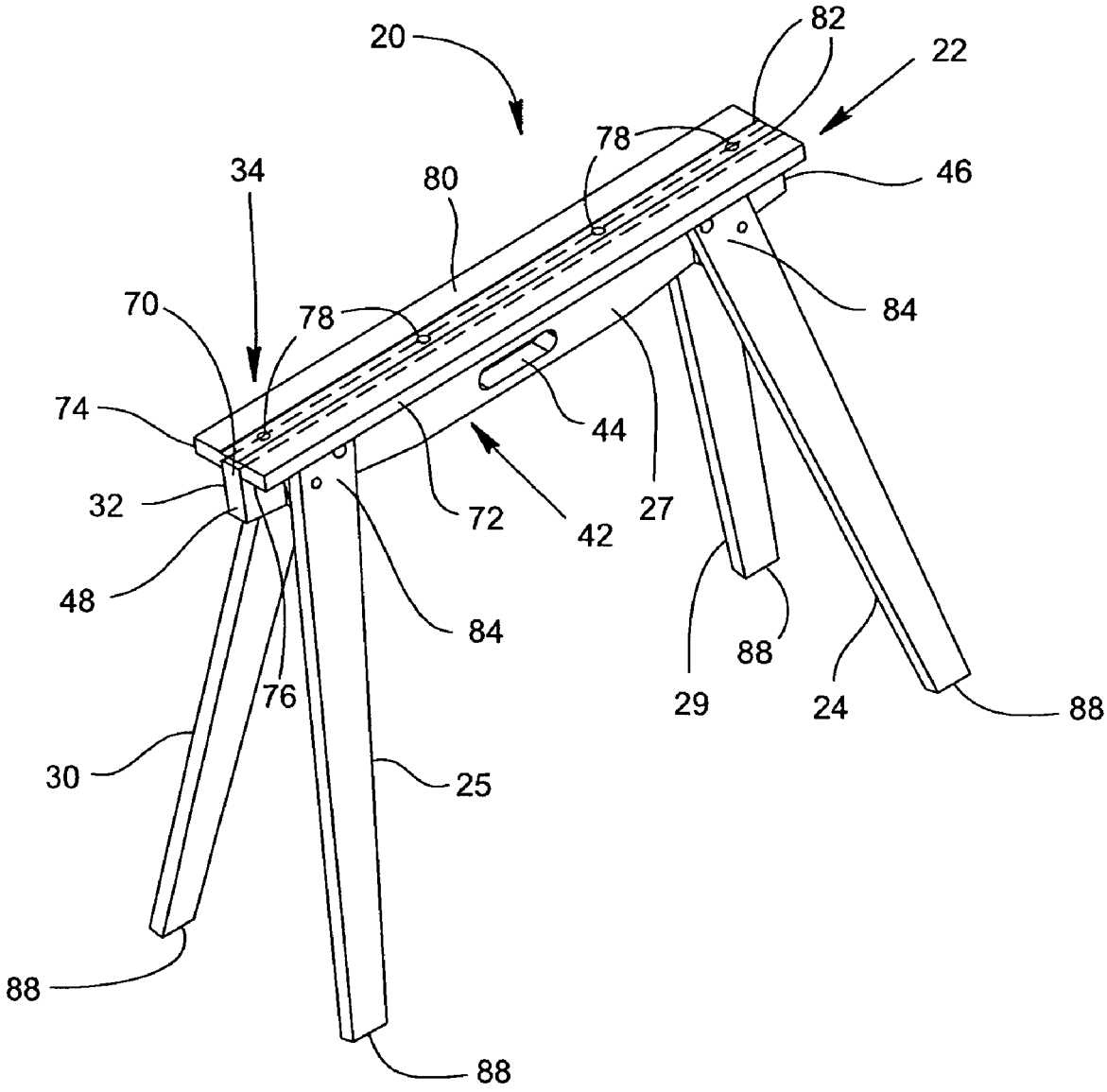
FIG. 2 is an isometric end view of the collapsible work horse shown in FIG. 1.

With reference to FIGS. 1 and 2 as needed, a work or saw horse 20 of the invention includes a support or cross beam 22, legs 24 and 25 mounted in spaced relationship to one another on side 27 of the support beam 22, and legs 29 and 30 mounted in spaced relationship to one another on opposite side 32 of the support beam 22. The invention is not limited to any particular design of the support beam 22; however, it should have sufficient structural strength to support the desired load. In one non-limiting embodiment of the invention, the support beam 22 had a T-shaped cross section, clearly shown in FIG. 2. Horizontal support member 34 of the beam 22 was made of wood having a thickness of 1 inch, a width of 3.5 inches, and a length of 46 inches. Vertical support member 42 of the beam 22 was made of wood having a thickness of 1 inch and a length of 46 inches. The width of the vertical support member 42 varied in width across its length to provide access to centrally located elongated opening or cut out 44 when the legs 24, 25, 29, and 30 are moved to the storage and/or transport position, e.g., the collapsed position, discussed in detail below. In this non-limiting embodiment of the invention, the vertical support member 42 had a width at ends 46 and 48 of 3.5 inches, a uniformly increasing width for a length of 19 inches from each of the ends 46 and 48 toward the center of the vertical support member 42, and a center portion having a length of 8 inches and a width of 5 inches.

Figure 3:
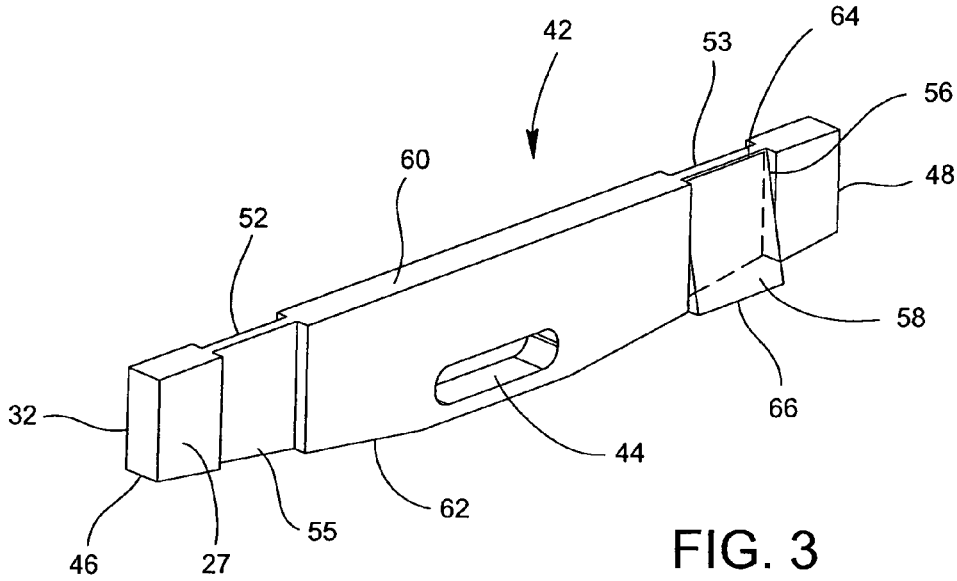
FIG. 3 is an isometric end view of a vertical support member of the collapsible work horse shown in FIG. 1.

In the following discussion, the sides 27 and 32 of the support beam 22 to which the legs 24, 25 and 29, 30, respectively, are secured in accordance to the teachings of the invention are the sides 27 and 32 of the vertical member 42. With reference to FIG. 3, each of the sides 27 and 32 of the vertical member 42 has a pair of cut outs 52, 53 and 55, 56, respectively, to receive a wedge member 58 (wedge member 58 only shown in cut out 56). The wedge members 58 provide an angle to the legs 24, 25 and 29, 30 in relationship to the support beam 22 when the legs 24, 25 and 29, 30 are extended, e.g., the work horse 20 is in the work position, as shown in FIG. 2. In the non-limiting embodiment of the invention under discussion, the cut outs 52, 53 and 55, 56 had a width of 3.5 inches, a depth of 3/16 inch, and extend from top side 60 to bottom side 62 of the vertical support member 42. The wedge members 58 had a width and length of 3.5 inches, a thickness at one end, e.g., end 64, of 1 3/8 inches and a thickness at the opposite end, e.g., end 66 of 3/16 inch. The wedge members 58 were secured in their respective cut out 52, 53 and 55, 56 by wood screws, with the smaller end 64 of the wedge members 58 adjacent to, or level with, the top side 60 of the vertical member 42.

As can be appreciated, the invention is not limited to the shape of the cut outs 52, 53 and 55, 56 for receiving the wedge members 58. Further, the invention is not limited to the dimensions of the wedge members 58. For example and not limiting to the invention, the end 66 of the wedge members 58 can be increased relative to the end 64 of the wedge members 58 to increase the spaced distance between the legs 24 and 29, and 25 and 30, and the end 66 of the wedge members 58 can be decreased relative to the end 64 of the wedge members 58 to decrease the spaced distance between the legs 24 and 29, and 25 and 30 (see FIG. 2). Further, the invention is not limited to having cut outs 52, 53 and 55, 56 in the vertical support member 42 to contain the wedge members 58, and the invention contemplates the sides 27 and 32 of the vertical member 42 without the cut outs, and the wedge members 58 mounted on such surfaces. Still further, the invention is not limited to the technique used to secure the wedge members 58 to the vertical member 42, e.g., the wedge members 58 can be secured to the vertical member 42 by fasteners of the type discussed above and/or by adhesives.

The horizontal and vertical support members 34 and 42, respectively, can be joined together in any convenient manner. With reference to FIG. 2, in the non-limiting embodiment of the invention under discussion, a channel 70 (see also FIG. 10) centrally located between sides 72 and 74 is provided, e.g., cut into bottom surface 76 of the horizontal support member 34. The channel 70 had a depth of 3/16 inch and a width of 1 inch. The top side 60 of the vertical support member 42 was secured in the channel 70 by screws 78 passing through top surface 80 of the horizontal support member 34 into the top side 60 of the vertical support member 42 (see FIGS. 2 and 3). In the instance when the horizontal support member 34 is made of wood, two relief grooves 82 are imposed into the top surface 80 of the horizontal support member 34 (see FIGS. 2 and 10) to reduce warpage of the horizontal support member 34. As can be appreciated, the invention is not limited to the manner in which the vertical and horizontal members are joined together and any joining technique known in the art can be used in the practice of the invention.

Each of the legs 24, 25 and 29, 30 has one end 84 mounted to a respective one of the wedge members 58 (one of the wedge members 58 shown in FIG. 3) by a shaft 86 (see FIGS. 1 and 4) such that each of the legs are secured to their respective one of the wedge members 58 for rotational or pivotal movement about their respective shaft 86 to move between the extended or work position (shown in FIG. 1) to a collapsed position (shown in FIG. 4) for transporting and/or storing the work horse 20 in a manner discussed in detail below. As is appreciated, the invention is not limited to the manner in which the ends 84 of the legs 24, 25 and 29, 30 are secured to their respective one of the wedge members 58 which are secured to the vertical support member 42, as discussed above, and any fastening arrangement can be used. In the non-limiting embodiment of the invention under discussion, the shaft 86 was a screw and washer arrangement used to secure the ends 84 of the legs 24, 25 and 29, 30 to its respective one of the wedge members 58 for pivotal or rotational movement around the screw.

Figure 4:
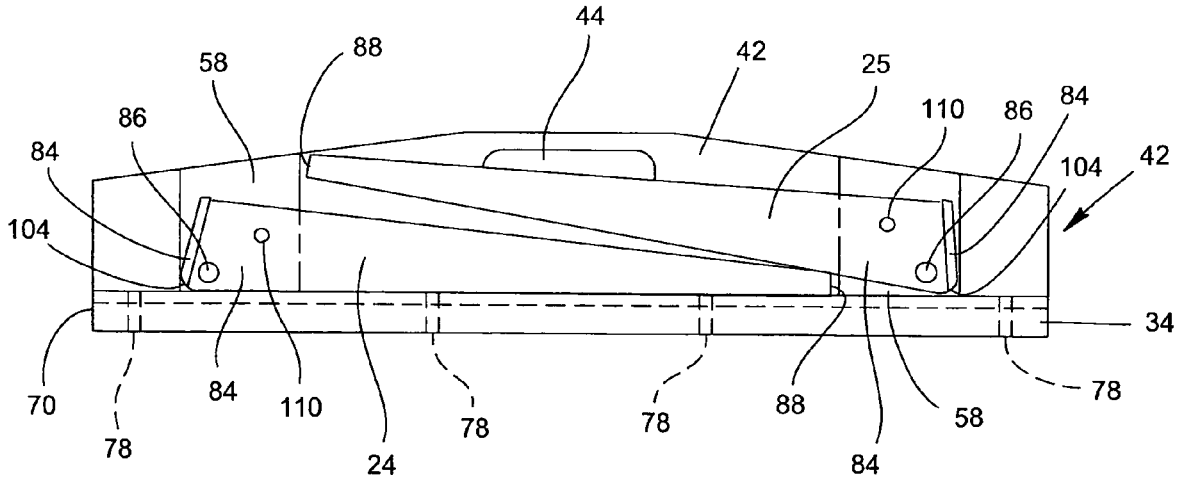
FIG. 4 is an elevated front view of the collapsible work horse shown in FIG. 1 in the collapsed condition for storage and/or transportation in accordance with the teachings of the invention.

Although not limiting to the invention and as can be appreciated from FIGS. 2 and 4, the legs 25 and 30 are pivoted around the shaft 86 in a counter-clockwise direction to move the legs 25 and 30 from the extended position as shown in FIG. 2 to the collapsed position shown in FIG. 4, and the legs 25 and 30 are pivoted around the shaft 86 in a clockwise direction to move the legs 25 and 30 from the collapsed position to the extended position. The legs 24 and 29 are pivoted around the shaft 86 in a clockwise direction to move the legs 24 and 29 from the extended position as shown in FIG. 2 to the collapsed position shown in FIG. 4, and the legs 24 and 29 are pivoted around the shaft 86 in a counter-clockwise direction to move the legs 24 and 29 from the collapsed position to the extended position.

Figure 6:
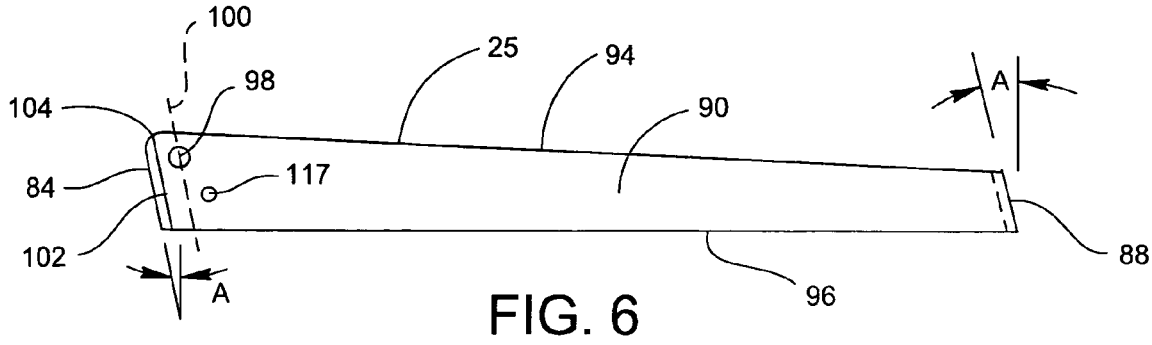
FIG. 6 is an elevated front view of the leg shown in FIG. 5.
Figure 5:
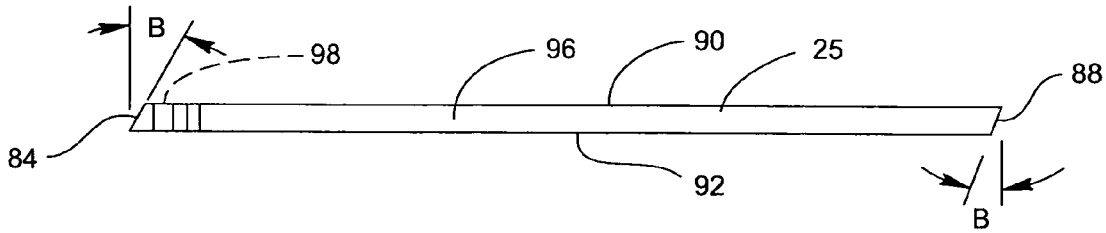
FIG. 5 is an elevated side view of a leg of the collapsible work horse of the invention.

In the following discussion, reference will be made to the leg 25, with the understanding that the discussion is applicable to the legs 24, 29, and 30, unless indicated otherwise. With reference to FIGS. 5 and 6, in the non-limiting embodiment of the invention under discussion, the leg 25 had a thickness of 1.00 inch as measured between surfaces 90 and 92 of the leg 25 (FIG. 5). End 88 of the leg 25 had a width of 1.25 inches as measured between sides 94 and 96 of the leg 25, and the end 84 had a width of 3 11/16 inches as measured between the sides 94 and 96. The leg 25 had a length of 32.25 inches as measured between the ends 84 and 88 along the side 96 of the leg 25. The side 94 of the leg 25 slopes toward the side 96, and the sides 94 and 96 do not slope toward one another for nesting of the legs when the work horse 20 is in the collapsed position, as shown in FIG. 4.

In the following discussion, the leg 25 will be discussed with the understanding that the discussion is applicable to the leg 30, unless indicated otherwise, and the reverse of the discussion is applicable to the legs 24 and 29, unless indicated otherwise, because, as discussed above, the legs 25 and 30 move in an opposite clockwise direction when moving from the extended position to the collapsed position and from the collapsed position to the extended position.

The ends 84 and 88 of the leg 25 each form an angle A between the sides 94 and 96, as shown in FIG. 6, such that the distance between the ends 84 of the legs 24 and 25 on the side 27 of the vertical support member 42 (see FIG. 2) increases as the distance from the vertical member 42 increases, and the distance between the ends 84 of the legs 29 and 30 on the side 32 of the vertical support beam 42 increases as the distance from the vertical member 42 increases, for stability of the work horse 20 when the legs are extended and the work horse 20 is in the upright or work position. In the non-limiting embodiment of the invention under discussion, the angle was 12 degrees. The ends 84 and 88 of the leg 25 between the surfaces 90 and 92 each beveled to have an angle B, as shown in FIG. 5, such that the distance between legs 24 and 29, and between the legs 25 and 30, increases as the distance from the vertical support member 42 increases for stability of the work horse 20 when the legs are extended and the work horse 20 is in the upright or work position. In the non-limiting embodiment of the work horse under discussion, the angle B was 20 degrees.

In the non-limiting embodiment of the invention under discussion, hole 98 extends through the surfaces 90 and 92 to receive the screw 78 about which the leg 25 rotates. The hole 98 is on a center to side 94 spacing of 13/16 inch, and on a center to end 84 spacing of 1⅞ inches as measured between an imaginary line 100 extending through the center of the hole 98 and parallel to straight portion 102 of the end 84 at the surface 90 of the leg 25. Corner 104 of the leg 25 between the end 84 and the side 94 is rounded as shown in FIG. 6 to move the rounded corner 104 under the horizontal beam 34 (see FIG. 2) as the leg 25 is rotated about the screw 78. In the non-limiting embodiment of the invention under discussion, the rounded corner 104 of the leg 25 had a radius of 1⅞ inches.

As can be appreciated, the ends 84 of the legs 24, 25, 29 and 30 are shaped, e.g., corner 104 rounded, to provide for rotation of the legs between the work position (FIG. 2) and the collapsed position (FIG. 4). With reference to FIGS. 1 and 2 and as mentioned above, the legs 25 and 30 move in a clockwise direction opposite to the clockwise direction of the legs 24 and 29 when moving from the work position to the collapsed position. As is appreciated by those skilled in the art, the particulars relating to the rounded corner 104 at the end 84 of the legs 25 and 30 discussed above are opposite to the particulars relating to the rounded corner at the end 84 of the legs 24 and 29 because they move in an opposite direction to the legs 25 and 30 when the legs are moved to the same position.

As can be appreciated, the invention is not limited to any synchronized movement among the legs 24, 25, 29, and 30, e.g., the movement of the legs 25 and 30 in a counter-clockwise direction, and the movement of the legs 24 and 29 in the clockwise direction, to move into the work position. However, in the preferred embodiment of the invention, the legs 25 and 30 move in a direction opposite to the direction of the legs 24 and 29 when moving the legs to the same position so that the work horse 20 of the invention can be collapsed into a convenient carrying and storage arrangement, e.g., as shown in FIG. 4.

Figure 7:
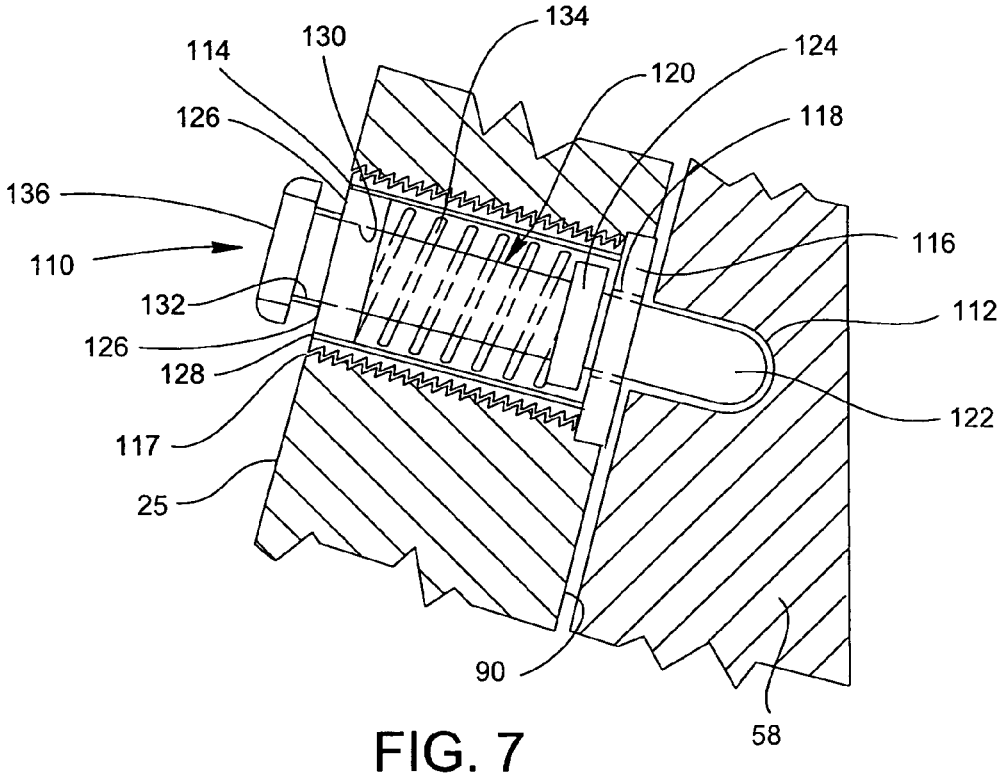
FIG. 7 is a view taken along lines 7-7 of FIG. 1 and having portions removed for purposes of clarity.

In another embodiment of the invention, the legs 24, 25, 29, and 30 are secured in the work position by a leg lock assembly 110. In the non-limiting embodiment of the invention under discussion, the leg lock assembly 110 is a spring-biased plunger 110 mounted in hole 112 in the wedge member 58 (the hole 112 clearly shown in FIG. 7). With continued reference to FIG. 7, the spring-biased plunger 110 includes a cylindrical housing 114 having a flanged end 116 mounted in the hole 117, with the flanged end 116 flush with the surface 90 of the leg 25 facing the wedge member 58, as shown in FIG. 7. The flanged end 116 has an opening 118 having a diameter less than inside diameter of the housing 114. A plunger 120 has an engaging end 122 sized to fit into the opening 118 of the flanged end 116, and a shoulder 124 spaced from the engaging end 122 of the plunger 120 sized to fit within the housing 114 and not pass through the opening 118 in the flanged end 116. A retainer nut 126 having external threads (not shown) is threaded into opposite end 128 of the housing 114 having internal threads (not shown) at the end 128. The retainer nut 126 has an opening 130 sized to pass end 132 of the plunger 120. A coil spring 134 was mounted on the plunger 120 between the retainer nut 126 and the shoulder 124 of the plunger 120. The biasing force of the spring 134 acts on the shoulder 124 of the plunger 120 to bias the engaging end 122 of the plunger 120 out of the housing 114 into the hole 112 in the wedge member 58. The end 132 of the plunger 120 extends out of the retainer nut 126 and has a knob 136 secured thereto for ease of moving the engaging end 122 of the plunger 120 into the housing 114 against the biasing action of the spring 134.

With the legs 24, 25, 29, and 30 of the work horse 20 in the extended position, the work horse 20 is in the work position (see FIG. 1) and the engaging end 122 of the plunger 120 of the leg lock attachment assembly 110 of each leg 24, 25, 29, and 30 is biased by the spring 134 into the hole 112 of the wedge member 58 (see FIG. 7) to lock the legs in the extended position. To move the legs to the collapsed position shown in FIG. 4, the knob 136 of the leg lock attachment assembly 110 of the legs 24, 25, 29, and 30 is moved away from the wedge member 58 to move the engaging end 122 of the plunger 120 out of the hole 112 in the wedge member 58 against the biasing force of the spring 134. With the engaging end 122 of the plunger 120 out of the hole 112 in the wedge member 58, the leg is rotated into the collapsed position. The procedure is repeated for each of the legs. In the instance when the leg lock attachment assembly 110 is positioned on its respective one of the legs to have the engaging end 122 of the plunger 120 remain in contact with its respective one of the wedge members 58, the leg is moved from the collapsed position to the work position, and the biasing action of the spring 134 moves the engaging end 122 of the plunger 120 into the hole 112 in the wedge member 58 when they are aligned with one another. In the instance when the leg lock attachment assembly 110 is positioned on its respective one of the legs to have the engaging end 122 of the plunger 120 clear its respective wedge member 58, the biasing action of the spring 134 moves the engaging end 122 of the plunger 120 out of the housing 114 when the engaging end 122 clears the wedge member 58. In this instance, as the leg is moved to the work position, the knob 136 is moved away from the leg to move the engaging end 122 of the plunger 120 into the housing 114 until the engaging end 122 clears its respective one of the wedge members 58. Thereafter, the knob 136 is released to move the engaging end 122 under the biasing action of the spring 134 against the wedge member 58, and the biasing action of the spring 134 moves the engaging end 122 of the plunger 120 into the hole 112 in the wedge member 58 when they are aligned with one another. The above is repeated for each of the legs to lock the legs in the work position.

As can be appreciated, the invention contemplates a work horse having more than two legs, e.g., having 3, 4 or more legs, on each side of the vertical support member 42, and having the same or a different number of legs on the sides of the vertical support member 42. Further, as can be appreciated, the invention is not limited to the material of the work horse and the work horse can be made of any material that can support the expected load to be supported by the work horse. Materials that can be used in the practice of the invention to make the work horse of the invention include but are not limited to metal, wood, plastic, pressed wood, metal and/or fiber glass reinforced plastic. In the instance when the work horse is made of wood, the relief grooves 82 (see FIGS. 2 and 10) are provided on the top surface 80 of the horizontal support member 34 to reduce warpage of the wood.

Figure 8:
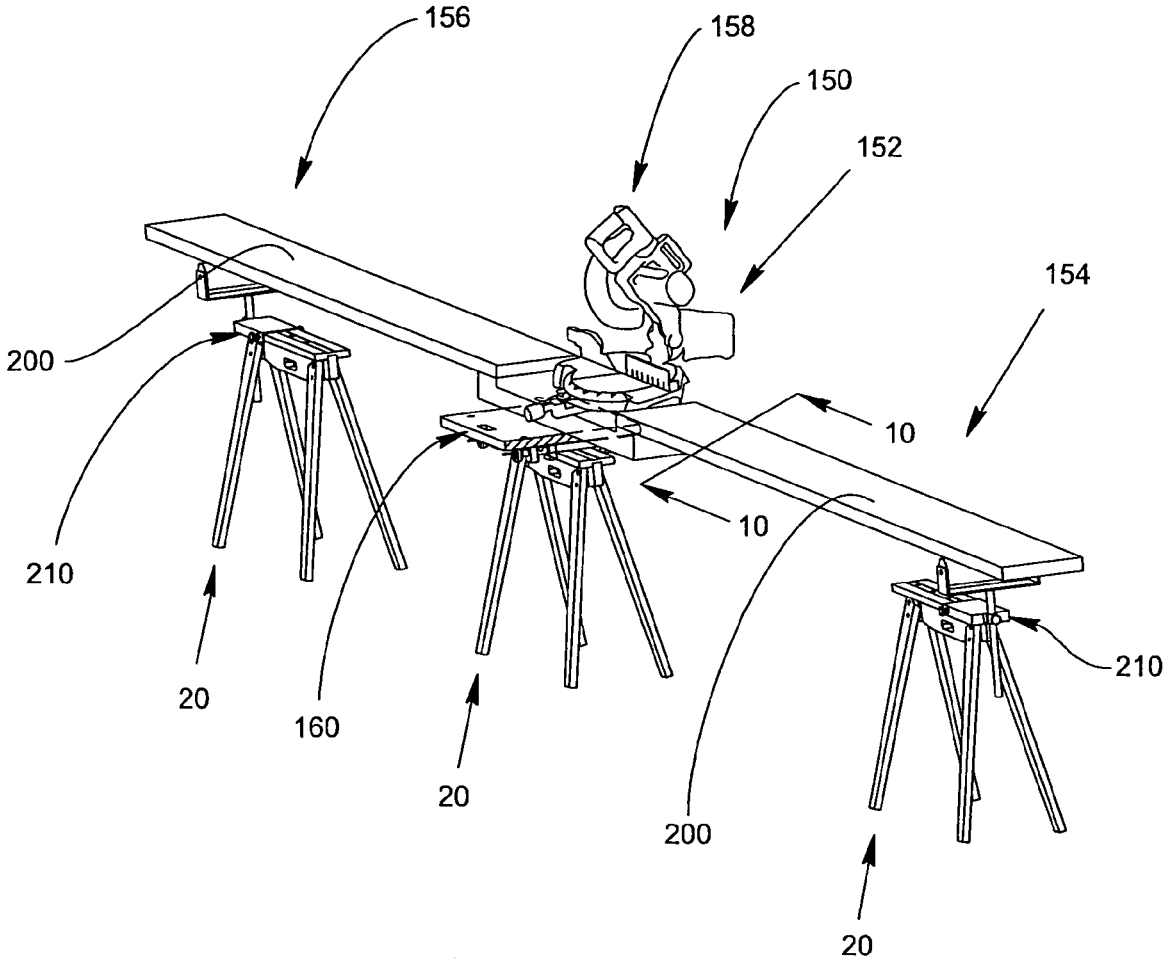
FIG. 8 is an isometric front view having portions removed for purposes of clarity of a work station incorporating features of the invention and including a non-limiting embodiment of the collapsible work horse of the invention.

With reference to FIG. 8, there is shown a work station 150 incorporating features of the invention which include but are not limited to a plurality of work horses 20 of the type discussed above. As can be appreciated, the work station 150 is not limited to using the work horse 20 of the invention and any type of work horse can be used. The work station 150 shown in FIG. 8 includes a shaping station 152, a work piece support position 154 on the right side, and a work piece support position 156 on the left side of the shaping station 152. In one non-limiting embodiment of the invention, the shaping station 152 includes a working tool 158 securely mounted on a tool support or tool supporting member 160 securely mounted on a work horse 20 in a manner discussed below. The working tool 158 is not limiting to the invention and can be any type of tool for shaping or joining materials, e.g. and not limiting to the invention, a drilling machine, a punching machine, a welding machine, or cutting machine. The working tool 158 can be motor and/or hand operated. In one non-limiting embodiment of the invention, the working tool 158 was a motor driven radial miter saw. In the following discussion, the working tool will be referred to as miter saw, however, as is appreciated, the invention is not limited thereto.

Figure 9:
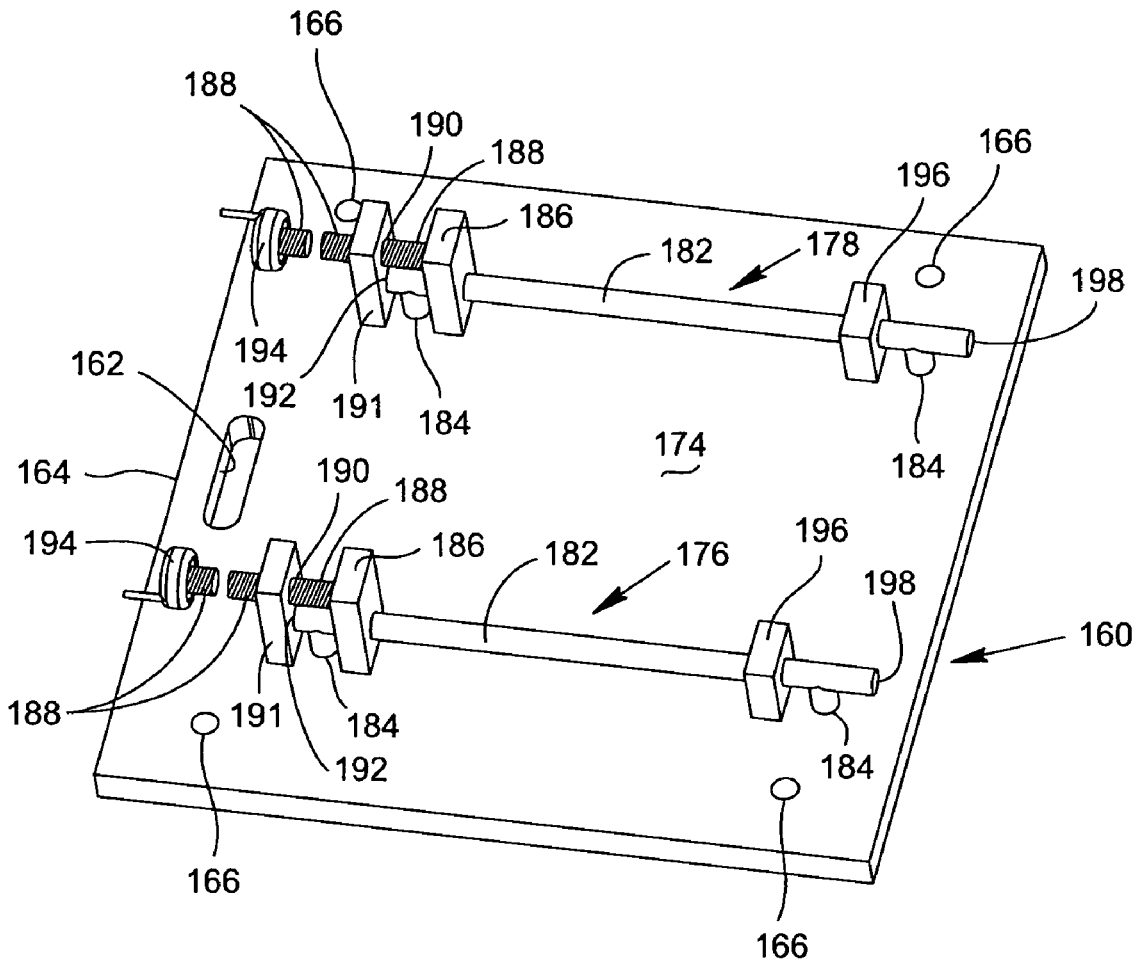
FIG. 9 is an isometric bottom view of a non-limiting embodiment of a tool supporting platform of the invention.
Figure 10:
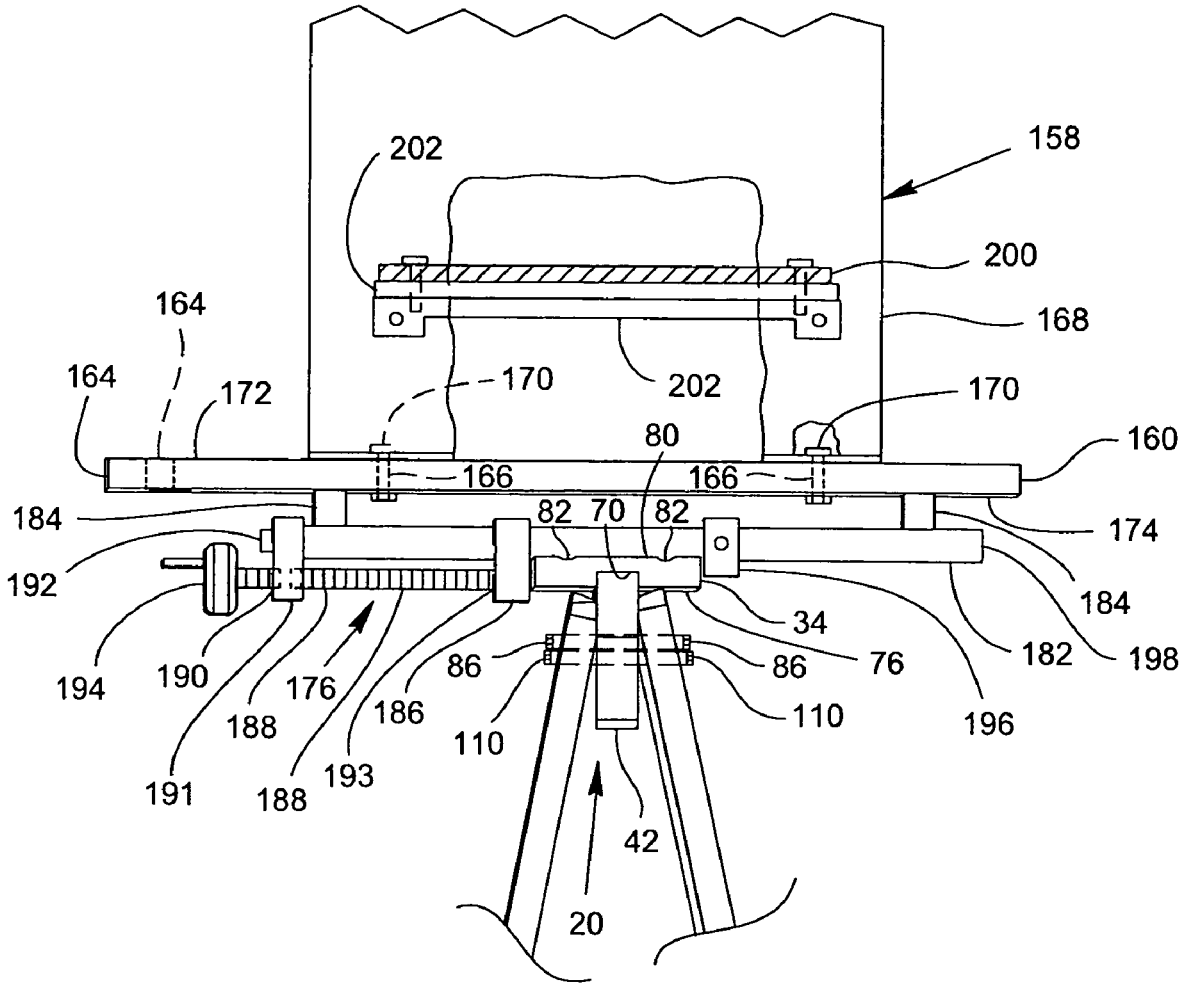
FIG. 10 is a view taken along lines 10-10 of FIG. 8 and having portions of the shaping tool removed for purposes of clarity.

With reference to FIG. 9, the tool supporting member 160 has an elongated cut out 162 adjacent one side, e.g., side 164, of the tool supporting member 160 for ease of carrying the tool supporting member 160, and has a plurality of spaced holes 166 which are aligned with mounting holes (not shown) in base 168 of the miter saw 158 (see FIG. 10). The tool supporting member 160 can be made of any structurally stable material. In the practice of a non-limiting embodiment of the invention, the table 160 was made of 0.75 inch thick plywood. Securing arrangements, e.g. and not limiting to the invention, nut and bolt members 170 (see FIG. 10) are used to secure the miter saw 158 to upper surface 172 of the tool supporting member 160. Mounted on opposite or lower surface 174 of the tool supporting member 160 is a pair of clamps 176 and 178 to secure the tool supporting member 160 to the horizontal member 34 of the work horse 20 (see FIG. 10).

The invention is not limited to the type of clamps 176 and 178 used to secure the tool supporting member 160 to the work horse 20. In the non-limiting embodiment of the invention under discussion, the clamps 176 and 178 each included a guide shaft or pipe 182 mounted to, and spaced from, the lower surface 174 of the tool support 160 and spaced from one another. The clamp 176 will be discussed with the understanding that the discussion, unless indicated otherwise, is applicable to the clamp 178. The guide shaft 182 of the clamp 176 was mounted on posts 184 to space the guide shaft 182 from the lower surface 174 of the tool support 160. The guide shaft 182 was secured against the posts 184 and the posts 184 secured against the lower surface 174 of the tool support 160 by a machine screw (not shown) passing through the upper surface 172 of the tool support 160, through the posts 184 and threaded into the guide shaft 182. A jaw clamp 186 is mounted on the pipe 182 to slide between the posts 184. A threaded drive shaft 188 passes through an internally-threaded passageway 190 of collar 191 secured to end 192 of the guide shaft 182 with end 193 of the threaded drive shaft 188 rotatably mounted to the jaw clamp 186, and a handle 194 secured to opposite end of the threaded drive shaft 188. With this arrangement, rotating the handle 194 in a first direction moves the jaw clamp 186 away from the end 192 of the guide shaft 182 and rotating the handle 194 in the opposite direction moves the jaw clamp 186 toward the end 192 of the guide shaft 182.

A lockable jaw clamp 196 is mounted on the guide shaft 182 adjacent opposite end 198 of the guide shaft 182 to slide toward and away from the end 198 of the guide shaft 182. The lockable jaw clamp 196 is moved to a predetermined location on the guide shaft 182 and secured in position in any convenient manner, e.g., by a screw passing through the jaw clamp 196 to engage the guide shaft 182, by a spring-biased engaging member, or by an off center wheel rotated to engage the guide shaft 182. With this arrangement, the tool support 160 can be set on the work horse 20 to have a more equal weight distribution of the working tool 158 mounted on the tool support 160.

As is appreciated by those skilled in the art, cutting an end of corner molding requires support for long pieces of corner molding, e.g., pieces having a length of 12 feet. In this embodiment of the invention, a 2 inch by 12 inch by 16 feet piece of lumber designated by the number 200 (see FIGS. 8 and 10) was used to support the corner molding (not shown). An angle iron 202 was secured to each of the opposite sides of the base 168 of the working tool 158, and an end of each of the pieces of lumber 200 was secured to one of the angle irons 202. The other end of the pieces of lumber 200 was supported at its respective one of the work piece support positions 154 and 156 by a roller support assembly or work piece support 210 mounted on the work horse 20. In the following discussion, the roller support assembly 210 of the work piece support position 154 will be discussed with the understanding that the discussion, unless indicated otherwise, is applicable to the roller assembly 210 of the support position 156.

The roller support 210 includes a base 212 that fits over an end of the horizontal member 34 of the work horse 20 and is secured thereto by rotating a threaded shaft 214 having an end passing through a threaded hole in the base 212. As can be appreciated, the invention is not limited to the structure or design of the base 212. In a non-limiting embodiment of the invention, the base was made by welding 4 pieces of angle irons together to form a base having three sides and an open end. A hole was drilled through one of the sides and a nut welded over the hole to receive a threaded shaft, e.g., the shaft 214. To prevent the end of the shaft 214 from cutting into the horizontal member 34 of the work horse 20, the end of the shaft 214 contacting the horizontal member 34 can have an enlarged end (not shown). Mounted on end 216 of the base 212 is a shaft retaining assembly 220 to receive shaft 222 of the roller assembly 224 and to secure the shaft 222 in the shaft retaining assembly 220, with the roller assembly 224 in a fixed elevated position.

The construction of the shaft retaining assembly 220 is not limiting to the invention. In the non-limiting embodiment of the invention under discussion, the shaft retaining assembly 220 was made by welding a section of pipe to the end 216 of the base 212 and providing a threaded hole in the section of the pipe to receive a screw 226 to engage the shaft 222 of the roller assembly 224. The roller assembly 224 further included a U-shaped member 228 mounted on the shaft 222 and having a roller 230 rotatably mounted in legs 232 of the U-shaped member 228.

In another non-limiting embodiment of the invention, the roller support assembly 210 and the tool support 160 can be mounted on the same work horse.

Figure 11:
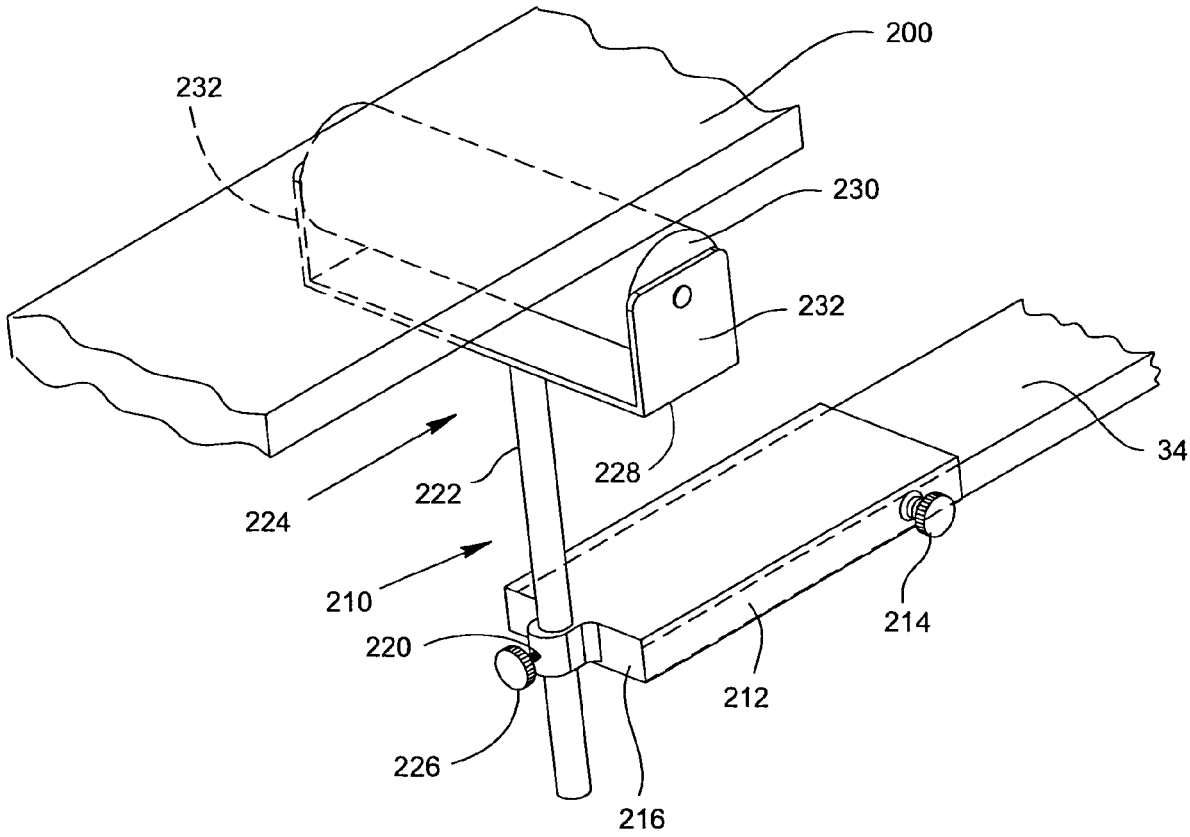
FIG. 11 is an isometric fragmented view of a non-limiting embodiment of a support member of the invention supporting a board.
Figure 12:
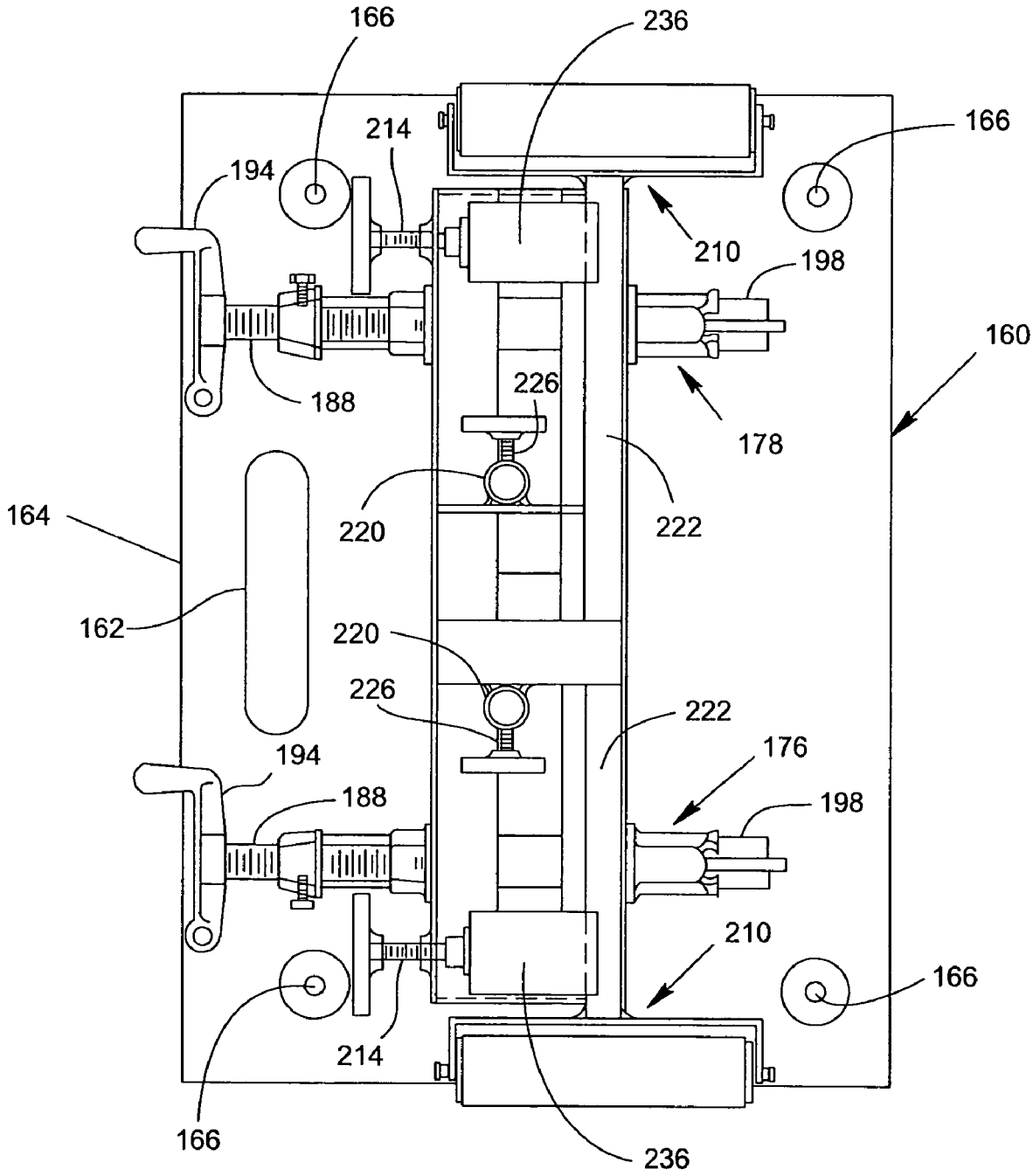
FIG. 12 is an elevated plan view showing the tool support of FIG. 9 and the support member of FIG. 11 in a storage and/or transportation arrangement in accordance with the invention.

In another non-limiting embodiment of the invention, the tool support 160 and the roller support assembly 210 can be packed together for storage or transportation. More particularly and with reference to FIGS. 11 and 12 as needed, the roller assembly 224 is removed from the shaft retaining assembly 220 and placed in the base 212 of the roller support assembly 210. A block of wood 236 is positioned between the shaft 222 of the roller assembly 224 and the threaded shaft 214 in the base 212. The threaded shaft 214 is rotated to move the block of wood 236 against the shaft 222 to secure the shaft 222 in the base 212 of the roller support assembly 210. The base 212 of one of the roller support assemblies 210 is placed between the jaw clamps 186 and 196 of one of the clamps 176 and 178, and the other one of the roller support assemblies 210 is placed between the jaw clamps 186 and 196 of the other one of the clamps 176 and 178, and the jaws moved toward one another to capture the bases 212 between the jaw clamps. The tool support 160 and the roller support assemblies 210 can now be moved by engaging the cut out 162 in the tool support 160.

Based on the description of the embodiments of the invention, it can be appreciated that this invention is not limited to the particular embodiments disclosed but it is intended to cover modifications that are within the spirit and scope of the invention, as defined by the appended claims.

What is claimed is:

1. A work station, comprising:

(1) a material shaping position, the material shaping position comprising:

(a) a collapsible work horse defined as a first collapsible work horse, comprising:

a support member defined as a first support member comprising a first elongated member having a first major surface and a second major surface, a first side and an opposite second side, and a second elongated member having a first side and an opposite second side, a first major surface and a second opposite major surface, the first side of the second elongated member of the first support member secured to the first major surface of the first elongated member of the first support member to provide the first support member with a T-shaped cross section;

a first pair of legs, each leg of the first pair of legs having a first end and an opposite second end, with the first end of the first pair of legs pivotally mounted to the first major surface of the second elongated member of the first support member, with the legs of the first pair of legs in spaced relationship to one another, the first pair of legs movable between a first position and a spaced second position, wherein with the first pair of legs in the first position, the first pair of legs is in an extended position;

a second pair of legs, each leg of the second pair of legs having a first end and an opposite second end, with the first end of the second pair of legs pivotally mounted to the second major surface of the second elongated member of the first support member, with the legs of the second pair of legs in spaced relationship to one another, the second pair of legs movable between a first position and a spaced second position, wherein with the second pair of legs in the first position, the second pair of legs is in an extended position; and a first part of a locking arrangement defined as a first locking arrangement mounted to each of the first ends of the first and the second pairs of legs adjacent a pivot point of each respective leg, and a second part of the first locking arrangement mounted to the first support member, wherein with the first and the second pairs of legs in the first position, the first and second parts of the first locking arrangement engage one another to securely fix the first and the second pairs of legs in the first position;

(b) a tool support, comprising:

a support platform having a first major surface and an opposite second major surface;

a first vise arrangement mounted on the second major surface of the support platform; and a second vise arrangement mounted on the second major surface of the support platform in spaced relationship to the first vise arrangement, wherein the second major surface of the support platform is mounted on the second surface of the first elongated member of the first support member, with the first and second vise arrangements engaging at least one of said sides of the first elongated member of the first support member; and (c) a shaping tool secured on the first major surface of the support platform of the tool support;

(2) a first support position, comprising:

(a) a collapsible work horse defined as a second collapsible work horse, comprising:

a support member defined as a second support member comprising a first elongated member having a first major surface and a second major surface, a first side and an opposite second side, and a second elongated member having a first side and an opposite second side, a first major surface and a second opposite major surface, the first side of the second elongated of the second support member secured to the first major surface of the first elongated member of the second support member to provide the second support member with a T-shaped cross section;

a pair of legs defined as a third pair of legs, each leg of the third pair of legs having a first end and an opposite second end, with the first end of the third pair of legs pivotally mounted to the first major surface of the second elongated member of the second support member, with the legs of the third pair of legs in spaced relationship to one another, the third pair of legs movable between a first position and a spaced second position, wherein with the third pair of legs in the first position, the third pair of legs is in an extended position;

a pair of legs defined as a fourth pair of legs, each leg of the fourth pair of legs having a first end and an opposite second end, with the first end of the fourth pair of legs pivotally mounted to the second major surface of the second elongated member of the second support member, with the legs of the fourth pair of legs in spaced relationship to one another, the fourth pair of legs movable between a first position and a spaced second position, wherein with the fourth pair of legs in the first position, the fourth pair of legs is in an extended position; and a first part of a locking arrangement defined as a second locking arrangement mounted to each of the first ends of the third and the fourth pairs of legs adjacent a pivot point of each respective leg, and a second part of the second locking arrangement mounted to the second support member, wherein with the legs of the third and fourth pairs of legs in the first position, the first and second parts of the second locking arrangement engage one another to securely fix the third and fourth pairs of legs in the first position; and (b) a work piece support defined as a first work piece support, comprising:

an engaging cover plate member defined as a first engaging cover plate member comprising a top plate, a first side and an opposite second side, and a third side between the first and second sides of the first engaging cover plate member;

a first lock screw passing through one of the first and second sides of the first engaging cover plate member, wherein the first engaging cover plate member is at an end of the first elongated member of the second collapsible work horse, is over the second surface of the first elongated member of the second collapsible work horse with an inner surface of the third side of the first engaging cover plate member facing the end of the first elongated member of the second collapsible work horse, and is secured in position over the second surface of the first elongated member of the second collapsible work horse by the first lock screw engaging one of the first and second sides of the first elongated member of the second work horse;

a shaft receiving hole securely mounted on the third side of the first engaging cover plate member, with a second lock screw passing through a wall of the shaft receiving hole of the first work piece support;

a cylindrical support defined as a first cylindrical support rotatably mounted on one end of a shaft defined as a first shaft, with the first shaft mounted in the shaft receiving hole of the first work piece support, wherein the first cylindrical support is movable toward and away from the first elongated member of the second work horse and is fixed above the first elongated member of the second work horse by the second lock screw engaging the first shaft of the first cylindrical support; and a supporting board defined as a first supporting board having one end portion supported by the first cylindrical support of the first work piece support and an opposite end of the first supporting board supported by the shaping tool;

(3) a second support position, comprising:

(a) a collapsible work horse defined as a third collapsible work horse, comprising:

a support member defined as a third support member comprising a first elongated member having a first major surface and a second major surface, a first side and an opposite second side, and a second elongated member having a first side and an opposite second side, a first major surface and a second opposite major surface, the first side of the second elongated member of the third support member secured to the first major surface of the first elongated member of the third support member to provide the third support member with a T-shaped cross section;

a pair of legs defined as a fifth pair of legs, each leg of the fifth pair of legs having a first end and an opposite second end, with the first end of the fifth pair of legs pivotally mounted to the first major surface of the second elongated member of the third support member, with the legs of the fifth pair of legs in spaced relationship to one another, the fifth pair of legs movable between a first position and a spaced second position, wherein with the fifth pair of legs in the first position, the fifth pair of legs is in an extended position;

a pair of legs defined as a sixth pair of legs, each leg of the sixth pair of legs having a first end and an opposite second end, with the first end of the sixth pair of legs pivotally mounted to the second major surface of the second elongated member of the third support member, with the legs of the sixth pair of legs in spaced relationship to one another, the sixth pair of legs movable between a first position and a spaced second position, wherein with the sixth pair of legs in the first position, the sixth pair of legs is in an extended position; and a first part of a locking arrangement defined as a third locking arrangement mounted to each of the first ends of the fifth and the sixth pairs of legs adjacent a pivot point of each respective leg, and a second part of the fifth locking arrangement mounted to the third support member, wherein with the fifth and the sixth pairs of legs in the first position, the first and second parts of the third locking arrangement engage one another to securely fix the fifth and sixth pairs of legs in the first position;

(b) a work piece support defined as a second work piece support, comprising:

an engaging cover plate member defined as a second engaging cover plate member comprising a top plate, a first side and an opposite second side, and a third side between the first and second sides of the second engaging cover plate member;

a lock screw defined as a third lock screw passing through one of the first and second sides of the second engaging cover plate member, wherein the second engaging cover plate member is at an end of the first elongated member of the third collapsible work horse, is over the second surface of the first elongated member of the third collapsible work horse within an inner surface of the third side of the second engaging cover plate member facing the end of the first elongated member of the third collapsible work horse, and is secured in position over the second surface of the first elongated member of the third collapsible work horse by the third lock screw engaging one of the first and second sides of the first elongated member of the third collapsible work horse;

a shaft receiving hole securely mounted on the third side of the second engaging cover plate member, with a lock screw defined as a fourth lock screw passing through a wall of shaft receiving hole of the second work piece support;

a cylindrical support defined as a second cylindrical support rotatably mounted on one end of a shaft defined as a second shaft, with the second shaft mounted in the shaft receiving hole of the second work piece support, wherein the second cylindrical support is movable toward and away from the first elongated member of the third collapsible work horse and is fixed above the second elongated member of the third collapsible work horse by the fourth lock screw engaging the shaft of the second cylindrical support; and a supporting board defined as a second supporting board having one end portion supported by the second cylindrical support of the second work piece support and opposite end of the second supporting board supported by the shaping tool.

2. The work station according to claim 1, wherein the first part of the locking arrangement of at least on of the first, second, and third collapsible work horses comprises a spring-biased plunger, and the second part of the locking arrangement of the at least one of the collapsible work horses comprises a hole to receive a first end of the plunger, wherein with each leg of the at least one of the collapsible work horses in the first position, the first end of the plunger is biased into the hole.

3. The work station according to claim 2, wherein each of the legs of the pairs of legs of the at least one of the collapsible work horses comprises a first surface and an opposite second surface, with the first surface at the first end of each leg portion of the support member of the at least one collapsible work horse, the plunger comprises a second opposite end wherein a stop member is between the first and second ends of the plunger, and the first part of the locking arrangement of the at least one of the collapsible work horses further comprises:

a housing having a first open end at the first side of each respective leg and an opposite second open end at the second surface of each respective leg, with the first and second openings smaller than the stop member to capture the stop member of the plunger in the housing;

the first end of the plunger biased to extend out of the first end of the housing and the second end of the plunger extending out of the second end of the housing; and a spring mounted on the plunger and in the housing between the second end of the housing and the stop member of the plunger, wherein moving the second end of the plunger out of the housing compresses the spring, and then releasing the second end of the plunger moves the stop member toward the first end of the housing under the biasing action of the spring.

4. The work station according to claim 1, wherein the first surface of the first elongated member of at least one of the first, second, and third collapsible work horses has a groove to receive the first side of the second elongated member of the at least one of the collapsible work horses, and the second surface of the first elongated member of the at least one of the collapsible work horses has a pair of spaced grooves between a first end and an opposite second end of the first elongated member of at least one of the collapsible work horses;

the support member of the at least one of the collapsible work horses further comprises a first pair of spaced wedge members secured to the first surface of the second elongated member of the at least one of the collapsible work horses between the first end of the first pair of legs of the at least one of the collapsible work horses and the first surface of the second elongated member of the at least one of the collapsible work horses, and a second pair of spaced wedge members secured to the second surface of the second member of the at least one of the collapsible work horses between the first end of the second pair of legs of the at least one of the collapsible work horses and the second surface of the second member of the at least one of the collapsible work horses, with a wider end of each wedge member spaced from the first elongated member of the at least one of the collapsible work horses.

5. The work station according to claim 1, wherein at least one of the first and second vise arrangements of the tool support comprises:

a guide shaft mounted to the support platform in spaced relationship to the second surface of the support platform;

a first jaw member slidably mounted on the guide shaft;

a detachably securing arrangement mounting the first jaw member, wherein with the detachably securing arrangement in a non-engaged position, the first jaw member can move along the shaft, and with the detachably securing arrangement in an engaging position, the first jaw member is secured in a position on the guide shaft;

a second jaw member mounted on the guide shaft; and a screw drive mounted on the guide shaft and operatively connected to the second jaw member to move the second jaw member toward the first jaw member to engage the at least one of said sides of the first elongated member and to move the second jaw member away from the first jaw member.

6. The work station according to claim 1, wherein the support platform of the tool support has a cut out adjacent a side of the support platform of the tool support, and the first and the second work piece supports are capable of being set in a storage position on the tool support wherein the first engaging cover plate member and the shaft of the first cylindrical support is between the first jaw member of the tool support, and the second engaging cover plate member and the shaft of the second cylindrical support is between the second jaw members of the tool support.

* * * * *

UNITED STATES PATENT AND TRADEMARK OFFICE

CERTIFICATE OF CORRECTION

PATENT NO. : 7,766,125 B2
APPLICATION NO. : 11/503728
DATED : August 3, 2010
INVENTOR(S) : Fowler It is certified that error appears in the above-identified patent and that said Letters Patent is hereby corrected as shown below:

Column 15, line 4, Claim 2, "at least on of" should read -- at least one of --

Signed and Sealed this
First Day of March, 2011

David J. Kappos

David J. Kappos
*Director of the United States Patent and Trademark Office*